US005633623A

United States Patent [19]

Campman

[11] Patent Number: 5,633,623

[45] Date of Patent: May 27, 1997

[54] PERSONAL INDICATOR WITH LIGHT EMISSION MULTIPLYING MICROPRISM ARRAY

[76] Inventor: James P. Campman, P.O. Box 167, Transfer, Pa. 16154-0167

[21] Appl. No.: 391,011

[22] Filed: Feb. 21, 1995

[51] Int. Cl.[6] ..... G08B 5/00

[52] U.S. Cl. ..... 340/321; 340/331; 340/332; 340/691; 340/693; 340/815.45; 340/815.55; 340/815.73; 340/815.76; 362/83.3; 362/157; 362/800

[58] Field of Search ..... 340/321, 331, 340/332, 691, 693, 815.4, 815.45, 815.47, 815.55, 815.73, 815.75, 815.76; 345/46, 39; 362/83.1, 83.3, 157, 800; 359/40, 48

[56] References Cited

U.S. PATENT DOCUMENTS

| | | | |
|---|---|---|---|
| 1,263,333 | 4/1918 | Madden | 340/815.76 |
| 1,407,427 | 2/1922 | Kloneck | 340/815.76 |
| 1,431,639 | 10/1922 | Ellithorpe | 340/815.76 |
| 1,964,325 | 6/1934 | Lebby | 340/815.76 |
| 2,623,934 | 12/1952 | De Bow et al. | 340/321 |
| 2,798,147 | 7/1957 | Orsatti | 340/815.76 |
| 2,972,739 | 2/1961 | Opper | 340/321 |
| 3,235,863 | 2/1966 | Lockhart | 340/815.76 |
| 3,671,101 | 6/1972 | Finch | 350/109 |
| 3,684,348 | 8/1972 | Rowland | 350/103 |
| 3,786,499 | 1/1974 | Jankowski et al. | 340/378 R |
| 3,810,168 | 5/1974 | Nishina | 340/383 |
| 3,911,430 | 10/1975 | Jankowski et al. | 340/378 R |
| 3,918,053 | 11/1975 | Towne et al. | 340/380 |
| 4,003,637 | 1/1977 | Masuoka | 350/286 |
| 4,191,943 | 3/1980 | Cairns et al. | 340/378.2 |
| 4,340,275 | 7/1982 | Henkes | 350/128 |
| 4,477,148 | 10/1984 | Tsuji et al. | 350/286 |
| 4,733,335 | 3/1988 | Serizawa et al. | 362/800 |
| 5,057,984 | 10/1991 | Kelley | 362/330 |
| 5,140,220 | 8/1992 | Hasegawa | 313/512 |
| 5,295,050 | 3/1994 | Helstern et al. | 340/815.42 |
| 5,396,350 | 3/1995 | Beeson et al. | 359/40 |
| 5,400,008 | 3/1995 | Toohey | 340/691 |

FOREIGN PATENT DOCUMENTS

| | | |
|---|---|---|
| 4-146401 | 5/1992 | Japan . |
| 5-100223 | 4/1993 | Japan . |

OTHER PUBLICATIONS

IBM Technical Disclosure Bulletin, Vo. 29, No. 1, pp. 276–279, Jun. 1986.

Brochure—Reflexite High Visibility Retroreflective Products, Refelxite Technology Center, Avon, CT, Feb. 1993.

*Primary Examiner*—Donnie L. Crosland

*Attorney, Agent, or Firm*—Alfred J. Mangels

[57] ABSTRACT

A safety device in the form of a compact, battery-operated, personal signalling system for providing light signals for personnel monitoring and detection purposes while operating under hazardous conditions. The device includes a light source that can emit either visible light or non-visible infrared light as periodic flashes. A light emission multiplier is provided between the light source and a protective, overlying panel to increase the visibility of the emitted light. The light emission multiplier is in the form of a thin sheet of vinyl plastic that includes a plurality of pyramidal microprisms on an outwardly facing surface. The microprisms operate to multiply the number of light emission points, thereby increasing the visibility of the safety device.

42 Claims, 4 Drawing Sheets

PERSONAL INDICATOR WITH LIGHT EMISSION MULTIPLYING MICROPRISM ARRAY

This invention relates to a personal light weight, light emitting safety device for use by personnel such as firemen, police, guards, diver covers, mineworkers and military situations among others. My prior art U.S. Pat, No. 5,317,305 on a Personal Alarm Device is one example of a personal light weight safety device which includes visual flashing safety lights.

BACKGROUND OF THE INVENTION

Field of the Invention

There is a demand in many fields of activity for small lightweight flashing indicators, safety devices, to be carried by personnel and to provide visual contact or location in dark areas. Such applications include firemen, police, guards, haz mat teams, inspectors, divers, military, covers, ski patrols, refineries, mining, warehousing and others. Such safety devices use flashing bright lights, such as L.E.D.'s and also utilize certain intense colors such as reds and oranges which penetrate darkness, smoke and water. Many such devices are available and are incorporated in what are known as personal alert safety systems (designated PASS). The aforementioned U.S. Pat. No. 5,317,305 is an excellent example of a PASS device using flashing indicator lights and includes information about other safety devices which have flashing indicators.

The known visual indicators use single periodically flashing light sources, usually with lens buttons of colored plastic, but none of the known devices include what I have designated a light emission multiplier in front of the light source or sources. This invention involves discovery of a light emission multiplying principle utilizing a thin synthetic plastic sheet with an array of micro prisms on one side of the sheet, the other side of the sheet being smooth, and such sheet being used as a lens array spaced a short distance from a small concentrated bright light source, which can be a bright visual light source or a light source in the invisible spectrum, e.g., near infrared and infrared spectrum. The sheet of micro prisms is disposed so the smooth side faces the light source and the side which contains the microprisms is facing away from the light source. It is intended that the phrases, light and light source, as used herein, include visible and invisible light. Such sheets of an array of microprisms are currently made and are available on the market, being manufactured by the Reflexite R Corporation, having offices in Avon, Connecticut and other places. The sheets of microprisms are used for retroreflective purposes on various guard devices, safety belts and barriers, but have never been used or proposed for use as light emission multipliers as a lens array in front of a light source. The micro prisms are very small, and can be made almost invisible to the naked eye, being measured in millionths of an inch.

Patents pertaining to the retroreflective sheets with micro prism arrays and the method and apparatus for making such material among others are as follows: U.S. Pat. No. 3,684,348 on Retroreflective Material; U.S. Pat. No. 3,689,346 on Method for Producing Retroreflective Material; and U.S. No. 3,935,359 on Retroreflective Sheeting and Method and Apparatus for Producing Same. The inventor of each of the above-identified patents is the same, William P. Rowland.

Prior art on L.E.D. devices used with diffusers of the emitted light can be found in the following patents, none of which teach use of L.E.D.'S with a lens sheet with a microprism array to provide multiplication of the light emission from the L.E.D.: U.S. Pat. No. 3,786,499 to ALFRED S. JANKOWSKI on ALPHANUMERIC DISPLAY PACKAGE; U.S. Pat. No. 3,810,168 to R. NISHINA on LUMINOUS DISPLAY PANEL WITH SEGMENT MATRIX & DIFFUSER; U.S. Pat. No. 3,911,430 to ALFRED S. JANKOWSKI et al on ALPHA-NUMERIC DISPLAY PACKAGE; 3,918,053 to H. TOWNE et al on DIGITAL DISPLAY; U.S. Pat. No. 4,191,943 to BRUCE CAIRNS et al on FILLER-IN-PLASTIC LIGHT-SCATTERING COVER; and U.S. Pat. No. 5,140,220 to Y. HASEGAWA on LIGHT DIFFUSION TYPE LIGHT EMITTING DIODE.

SUMMARY OF THE INVENTION

A primary object of this invention is to provide a light emitting or flashing indicator device of small size which uses one or more L.E.D.'s with a thin panel array of a sheet of microprisms used as a light emission multiplier cover or lens placed over the light emitting diode(s) L.E.D.'s resulting in a multiplication of the light source from each L.E.D. with a center point of light surrounded by six satellite or phantom lights spaced-apart around the central light source. The light source can be in the visible and/or invisible range, the invisible range specifically including infrared and near infrared ranges of the spectrum.

Another object resides in providing a light emitting indicator device, as described above, with the sheet or lens of the microprisms arrayed over and around the L.E.D.(s) so the multiplied light emission will be visible in an omnidirectional sense, i.e., 360° from the source. In connection herewith a further object resides in utilizing super bright solid state L.E.D.'s (3 candle power) as a visible light source which with the light emission multiplying use of microprisms provides a highly effective very bright visual beacon. It is also a further object to use colored vinyl sheeting for the microprism array, the colors being selected from reds, greens, yellows and others which result in high strength light penetration through darkness, smoke and water. A still further object resides in the use of solid state infrared and/or near infrared L.E.D.'s which in connection with the foregoing combination provide multiplied light emission not visible to the naked eye. A further object resides in providing circuitry and power source to enable light emission flashing, in a strobe effect, of the L.E.D.'s for a substantial length of time, by leaving the L.E.D.'s "on" for 10 milliseconds and "off" for 250 milliseconds so the average power consumed is minimal.

A still further object, in conjunction with the foregoing objects, resides in providing circuitry having an actuating switch which can be activated by a push button and de-activated by the same push button. An alternative and similar object resides in a modified circuit for use in an underwater light flashing device which utilizes a water or moisture activated switch unit replacing the push button activator and actuating switch. Another alternative and similar object resides in circuitry which has a magnetically actuated switch to turn the circuits "on" and "off", operated by a small removable, exterior magnet placed on the outside of the casing of the device and which, when removed, permits the magnetic switch to turn the circuit "on".

It is still another object to provide the foregoing light emitting device with microprism light emission multiplying cower or lens in units which are enclosed in water-proof or explosion-proof casing or which can be incorporated in prior art personal alarm safety devices, which have flashing light emission capability, with a minimum revision.

Further novel features and other objects of this invention will become apparent from the following detailed description, discussion and the appended claims taken in conjunction with the accompanying drawings.

BRIEF DESCRIPTION OF DRAWING

Various preferred structural assemblies of flashing visible or invisible light indicators which utilize the light emission multiplying principle of this invention, and the subcombination microprism array which affords the light emission multiplying effect, are disclosed in the accompanying drawing Figures in which.

DESCRIPTION OF THE PREFERRED EMBODIMENTS

Figure 6:
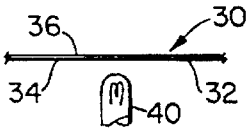
FIG. 6 is a schematic arrangement from one side showing a light source and a sheet form of an array of microprism in front of the light source.
Figure 7:
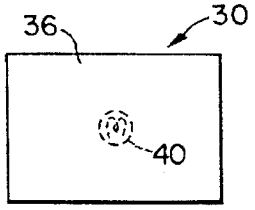
FIG. 7 is a schematic view looking at the front of FIG. 6 showing a plan view of the sheet of microprisms.
Figure 9:
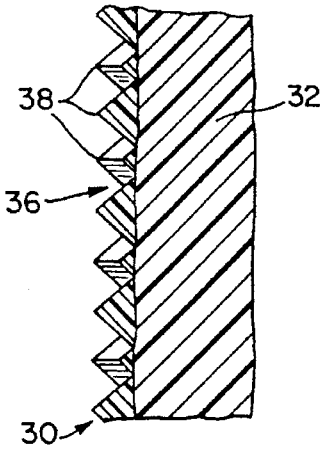
FIG. 9 is a section taken on line 9—9 of FIG. 8 illustrating the prismatic shapes of the elements and that, in the present invention, they are on the side of the sheet facing away from the light source.

This invention pertains to using a sheet of material which can be obtained on the market as noted above. The sheet 30, shown generally in FIGS. 6 and 7, and in greatly enlarged cross-section in FIG. 9, is a composite body of synthetic plastic structure, normally vinyl, which can be made with a body portion 32 with one smooth surface 34 and another surface 36 from which project a multiplicity of separately formed, minute pyramidal corner formations 38 having a side edge dimension of less than 0.025 inch. As described in U.S. Pat. No. 3,684,348, it is preferred to use a sheet material having a thickness of 0.002–0.030 inch and most desirably about 0.003–0.010 inch. In any event the pyramid prisms taught by the patent have three faces and are so small as to be invisible to the naked eye. The pyramid prisms could have more than three faces, e.g., four or more. The term microprisms or phrases microprism array or sheet of microprism array used relative to the present invention and in the claims means that the prisms are of minute size and are invisible to the naked eye as described in the previous two sentences. This invention uses the sheet 30 of an array of microprisms in the manner of a lens cover over a small intense concentrated source of light 40 which preferably is an L.E.D. although the source may be another light source device; such as an incandescent, krypton or infrared light bulb which incorporates small lens caps on the ends of the bulbs.

In the present invention the lens sheet material 30, with the array of microprisms on one side and with the other side smooth, is used in combination with one or more concentrated light sources 40 with the sheet 30 spaced from the end of the light bulb source a distance within the range of approximately 1–7 millimeters. The light emission multiplication feature of the lens sheet of three sided pyramidal microprisms results in a central concentration of light from the light source with six spaced apart phantom, or satellite, intense concentrations of light emissions surrounding the central concentration. The spaced apart locations effectively represent the six points of a hexagon. Thus the light source is effectively multiplied seven times. The number of satellite emissions will multiply in a larger number when the pyramids have more than three sides.

Figure 1:
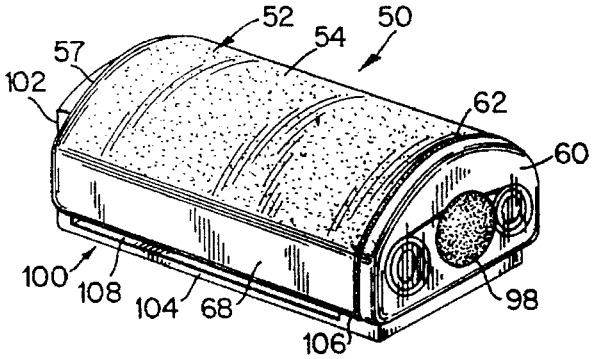
FIG. 1 is a top perspective view of a first embodiment of a light emitting indicator device incorporating my invention.
Figure 10:
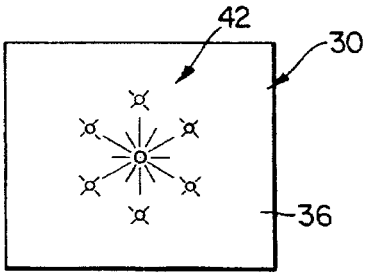
FIG. 10 is a plan view of a sheet of microprisms as in FIG. 7 with one L.E.D. light source behind the sheet and shows the six satellite or phantom light emissions surrounding the one central emission from the light source.
Figure 11:
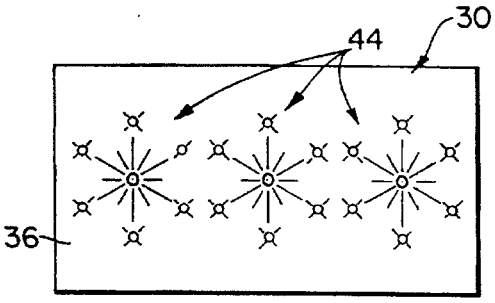
FIG. 11 is a plan view of a sheet of microprisms similar to FIG. 10 but having three L.E.D. light sources behind the sheet and illustrates twenty-one light emissions which are eighteen phantom lights and three L.E.D. light emission sources.

In a device as shown in FIG. 1, which will be described in detail, the tip of the L.E.D. light source is spaced approximately 5 mm. from the smooth side of the sheet of array of microprisms and under such conditions the visual light emission multiplication of the light source concentrations will occur at 42 as shown in FIG. 10 for a single L.E.D. light source and grouped at 44 as shown in FIG. 11 for a group of 3 L.E.D. light sources.

Figure 8:
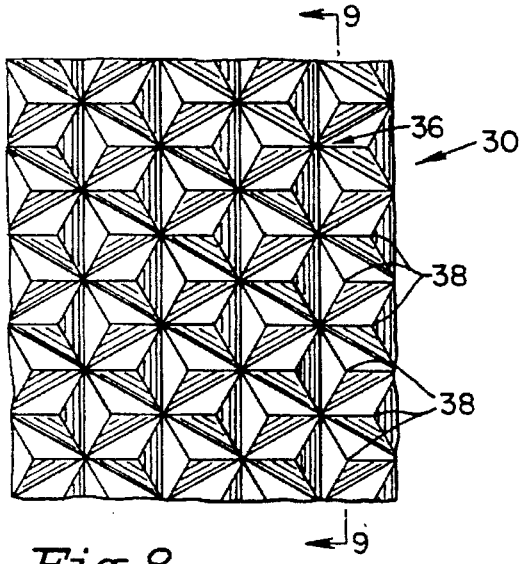
FIG. 8 is a highly magnified section of the sheet of microprism showing retroreflective elements on one side of the sheet.

It is the minute array of prisms 38 on the face 36 of the lens sheet which essentially are not visible to the naked eye and which cause the light source multiplication. A highly magnified plan view of the microprism array is shown in FIG. 8 and a section through that highly magnified plan view is seen in FIG. 9 to show the peaks of the triangular sided prisms 38.

GENERAL PURPOSE VISUAL FLASHING INDICATOR

Figure 2:
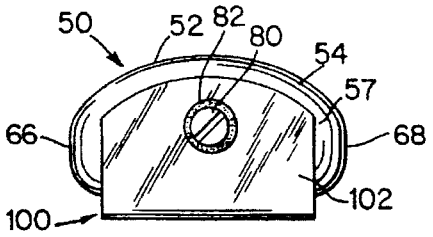
FIG. 2 is a rear view of the device shown in FIG. 1 illustrating the assembly bolt which hold the components together.
Figure 3:
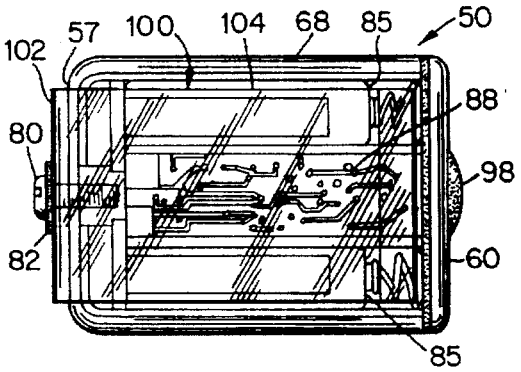
FIG. 3 is a plan view of the bottom of the device of FIG. 1 and illustrates the internal locations of batteries and printed circuitry.
Figure 5:
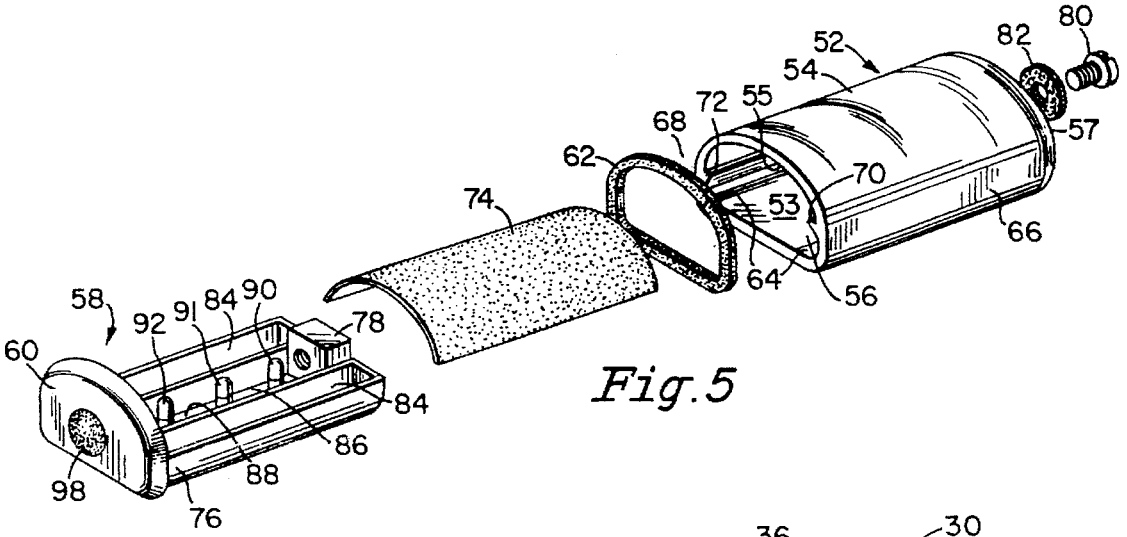
FIG. 5 is a reduced scale, exploded perspective view showing components of the device shown in FIG. 1.

The device 50 shown in FIGS. 1, 2 and 3, in actual size on the original drawing sheets, and in exploded perspective in FIG. 5 is one embodiment of a bright flashing visual indicator which utilizes the light multiplying principle described supra.

Unit 50 includes two major parts: a housing body or case 52 which is a lateral, hollow chamber (see Figures) with base wall 53, a convex upper wall 54 curved from side to side in the width dimension and open at one end 56 of its length and closed with a structurally integral end wall 57 at the other end; and a second part 58 which includes an end cap 60 that abuts and is tightly sealed, by a preformed gasket seal 62, against the open end 56 of the hollow body 52. The hollow chamber includes spaced apart longitudinal interior tracks 64 along its two side walls 66, 68. Upper edge portions of the tracks are shaped to provide upwardly facing longitudinal interior slit steps 70, 72 at the top of the interior of the side walls 66, 68 where they merge into the convex upper wall 54 and enable a sheet 74 with an array of microprisms to be curved and slipped into place within the hollow body 52 and held by the steps 70, 72 in matching conformity with the interior surface 55 of the curved upper wall 54 of the hollow body.

The second part, adjacent its end cap 60 carries a horizontal tray 76 integral with the end cap and shaped to fit between and slide along said longitudinal tracks 14 into said hollow body. Tray 76 at the end opposite end cap 60 includes a nut 78 integrally molded to the tray. The nut 78, when the tray is assembled, abuts the closed end wall 57 of the hollow body and enables the tray and hollow chamber 52 to be securely releasably fastened in assembly by a screw 80 and a ring seal 82. Tray 76, end cap 60 and the hollow chamber 52 are made from a clear polycarbonate plastic.

Figure 4:
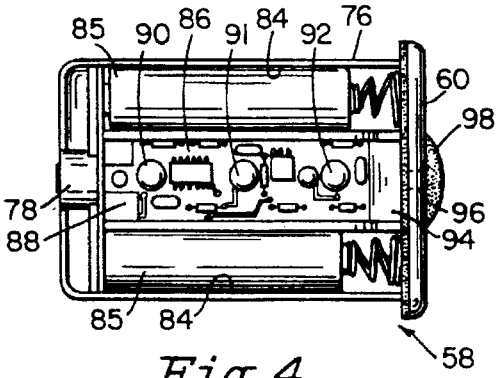
FIG. 4 is a top plan view of the tray with operating components shown at the left end of FIG. 5 and illustrates the assembly of L.E.D.'s, batteries and activator switch on the upper side of the printed circuit.

Tray 76 has three parallel subtrays, the two outer trays 84 receiving two AAA batteries 85 (see FIG. 4) which constitute the power source for the device. The center subtray 86 receives a small narrow printed circuit board 88 that mounts 3 Super bright L.E.D.'s 90, 91, 92 spaced apart along the center subtray 88 as seen in FIGS. 4 and 5. Encapsulation of the L.E.D.'s results in a clear plastic lens at the tip of each L.E.D. At the front end of the tray 76 adjacent end cap 60 is mounted a mini push button, microswitch 94 (see FIG. 4) with its push rod actuator projecting through an aperture 96 in the end wall into which is placed a sealed elastic push button 98 enabling the microswitch to be manually actuated from the outside of end cap 60 when the apparatus is assembled as device 60.

The end cap and tray provide the mounting structure for the L.E.D.'s 90, 91 and 92, the power means, batteries 85 and the operating and control circuitry on a printed circuit board 88. The printed circuit board and components, including switch and. L.E.D.'s can be encapsulated and sealed in a silicone plastic coating and, when the tray 76 and end cap 60 are placed in the hollow body 52 and tightly secured by the screw 80 and nut 78, the end cap gasket seal 62 and the seal washer 82 beneath the ring screw head and around the screw, provide a waterproof sealed device rendered waterproof to depths approximating 2000 feet. As noted above, the device 50 is depicted in full scale actual size in FIGS. 1 and 3 of the original drawings. The approximate dimensions of a successfully operative unit are 2⅜" length; 1⅝" width; and ⅞" thickness at crest of the convex cover and such a unit weights approximately two ounces. These values are not critical. The inside surface of the lens sheet of array of microprisms 74, when the device is assembled is spaced approximately 5 mm. from the tips of the L.E.D.'s and when the L.E.D.'s are energized and emitting light, the multiplied emission from each L.E.D. light source appears approximately as shown at 42 in FIG. 10 and from all three L.E.D.'s appears approximately as shown at 44 in FIG. 11.

CIRCUIT DIAGRAM FOR FIG. 1 EMBODIMENT

Figure 12:
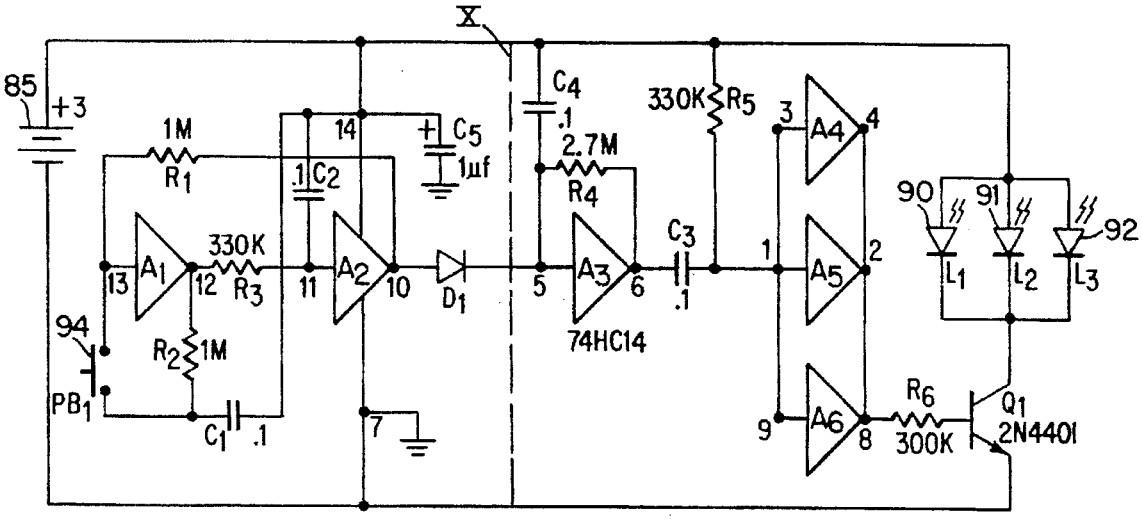
FIG. 12 is a circuit diagram for the device illustrated in FIG. 1.

The circuit diagram for the circuitry on the printed circuit board 88 for device 50, as shown in FIGS. 1–5, is seen in FIG. 12. Gates A1 through A6 are inverting amplifiers having a very high input impedance. The high input impedance allows the use of large values of biasing resistors (megohms), thus providing low power (current consumption for the total circuit). This circuit arrangement permits the circuit to be energized at all times because the power consumed by the circuit is less than the self-discharge rate of the power source.

Circuit performance is as follows: Gates (A1 and A2) work as an electronic switch each time pushbutton $9B_1$ (94) is depressed, i.e., Pin 10 will toggle between plus 3 volts and 0 volts. When Pin 10 is at 0 volts, diode (D1) is back biased permitting oscillator (A3) to generate a 20 Hertz square wave via its charge discharge network (C4)(R4). The signal appearing at Pin 6 is a symmetrical 20 Hertz square wave. Capacitor (C3) and resistor (R5) serve to differentiate this square wave such that the pulse appearing at buffer amplified Pins (4, 2 and 8) is a pulse 20 milliseconds wide occurring at a 20 Hertz rate. This pulse is coupled to power transistor Q1 via R6, causing Q1 to conduct in a strobe-like manner, and results in flashing the three L.E.D.'s L1, L2 and L3 (90, 91 and 92).

ELECTRONIC SWITCH

The microswitch 94 is a pushbutton switch that controls an electronic switch in the printed circuitry. The electronic switch is a flip flop circuit which activates and deactivates the circuitry to cause or stop flashing of the L.E.D.'s. Gates (A1) and (A2) comprise a bi-stable device. Assume that (A2) Pin 10 is at 0 volts, then Pin 13 of A1 is at 0 volts causing Pin 12 to be a plus 3 volts and the system is stable. Note that Capacitor (C1) has 0 volts dropped across it and is essentially connected to plus 3 volts. When switch 94 (PB1) is depressed a plus 3 volts is momentarily applied to Pin 13 causing Pin 12 to go to 0 volts and Pin 10 to go to plus 3 volts, the circuit then latches in this state via resistor (R1) and the circuit is in its second stable state.

Resistor (R3) and Capacitor (C2) serve as time delays to circumvent any accidental turn on or off of this circuit due to an accidental dropping or impact that could cause a momentary push-button closure.

The embodiment of the flashing indicator 50 shown in FIG. 1 includes an L-shaped rigid polycarbonate bracket 100 which includes a rear short leg 102 and a lower horizontal long leg 104. At the end of the long leg 104 a spacer block 106 is secured as by plastic bonding. The bracket 100 is mounted to the hollow body 52 with the short leg 102 against the end wall 57 and the long leg 104 extending under the base wall 53 of body 52 up to the open end 56 of body 52. The long leg 104 of bracket 100 is spaced apart from the base wall 53 a distance sufficient to define a slot 108 to permit passage of a belt or strap (not shown). The bracket 100 is secured at the end with the spacer 106 to the base wall 53 by fastening devices such as bonding and/or screws, and the short leg 102 includes an aperture permitting access to the fastener screw 80. When the screw 80 is in place, it cooperates with the hole in the short leg 102 to hold that end of the bracket 100 against the hollow body 52. When screw 80 is removed, the short leg 102 can be pulled slightly from the hollow body 52 to flex the long leg 104 sufficiently to enable passing a strap between the short leg 102 and the end wall 57 into the slot 108 between long leg 104 and the base wall 53. Normally, an end of a harness strap can be passed through the slot 108 and fastened to a harness clip without need to spring the bracket 100 as described.

Figure 13:
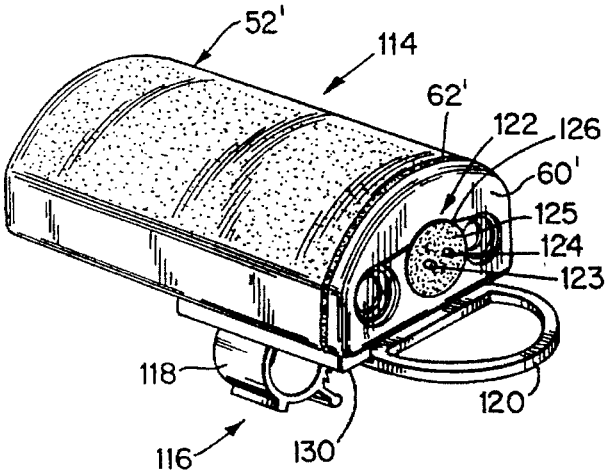
FIG. 13 is a top perspective view similar to FIG. 1, but showing a second embodiment of a flashing indicator for use in underwater environs, the primary differences being in a water activated switch on the front, instead of a push button.
Figure 14:
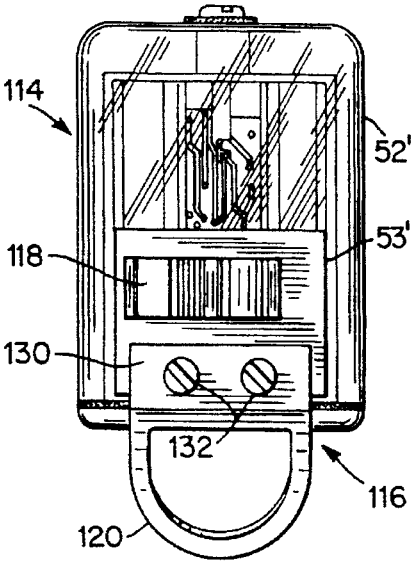
FIG. 14 is a bottom plan view of the device in FIG. 13 and shows an alternate fastening clip structure.
Figure 15:
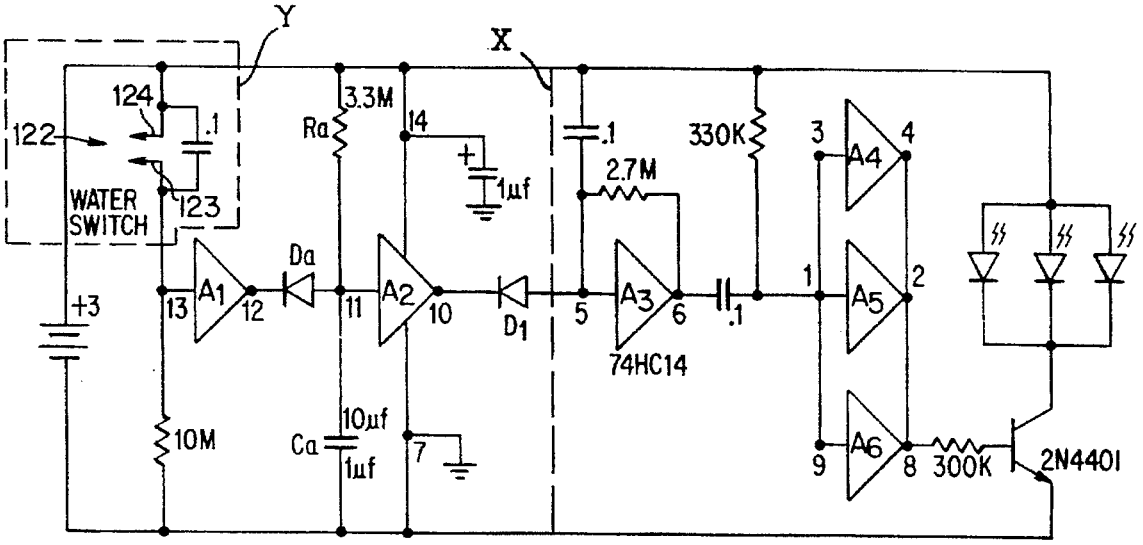
FIG. 15 is a circuit diagram for the device illustrated in FIG. 13.

UNDERWATER EMBODIMENT—FIGS. 13, 14 and 15

The underwater embodiment of the visual flashing indicator is shown as unit 114 in FIGS. 13 and 14 and its circuit is illustrated in FIG. 15. Excepting for the use of a water or moisture switch in lieu of the push button micro-switch, 94 and. manually operable elastic button 98 as provided on the general purpose device 50, and a modification of the circuitry, as will be described, the components, structure, assembly, and light emission multiplication principle of operation of unit 114 is the same as described hereinbefore in connection with FIGS. 1–11, and, as necessary, the same reference numbers with prime marks will be used in referring to FIGS. 13 and 14.

Unit 114 includes a hollow case 52' and the second part, including end cap 60', gasket seal 62' and the tray connected to the end cap 60', which carries the batteries, printed circuit board and L.E.D.'s, which preferably is sealed in a silicone plastic coating, as is described for the first embodiment. The FIG. 13 unit 114 is depicted with a different kind of attachment device 116, which has a flexible releasable clamp 118 and loop 120; however the same bracket structure shown on FIG. 1 (bracket 100) can be used on this embodiment if desired. In fact, any known suitable safety clip or clamp device can be used.

Clearly shown on the end cap 60' in FIG. 13 are the external parts of the water switch 122. Switch 122 includes two stainless steel pins 123 and 124 located in sealed fashion and passing through an insulator disc 125, which is secured and sealed at aperture 126 in the end cap 60' in place of the elastic button 98 of the first embodiment. At the inside of end cap 60' the two pins 122 and 123 are connected to the printed circuit board as shown in FIG. 15.

DIAGRAM FOR SECOND EMBODIMENT

In FIG. 15, all circuit functions to the right of the dashed line X are as previously described for the circuit in FIG. 12. As described for FIG. 12, the condition for the circuit in FIG. 15 to result in making the L.E.D.'s flash is for Pin 10 to be at 0 volts and D1 to be back biased. The water switch 122 includes two electrodes, pins 123, 124 that are exposed to the exterior of the case through a rubber gasket insulator or disc 125, positioned in aperture 126. When these electrodes and the exterior of the insulator disc 125 become wet, a circuit is completed between pins 123, 124 and causes Pin 12 of Gate A1 to switch low. This action causes Capacitor CA to discharge via Diode Oa which permits oscillator A3 to activate. If there is no water present on and between electrodes 123, 124, then Pin 12 will return to a plus 3 volts permitting Capacitor (Ca) to charge via Resistor (Ra) to a voltage level sufficient cause Pin 10 of (A2) to return to 0 volts, thus resetting the circuit and stopping flashing of the L.E.D.'s. There is an 18 second time delay before resetting after the unit is removed from water and the electrodes dry.

In this circuit, as distinguished from the FIG. 12 circuit, diode D1 is reversed, the resistor R3 is replaced by a Diode Da, C2 is replaced by a 3.3 meg. resistor Ra, capacitor Ca is inserted as shown and a 10 megohm resistor is added between pin 13 and ground.

FURTHER MODIFICATIONS/MAGNETIC SWITCH

Figure 22:
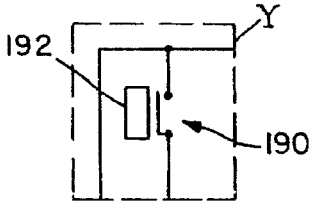
FIG. 22 is a schematic illustration of a magnetically actuated switch that can be used in lieu of the water actuated switch of FIG. 15.

The circuitry of the device can be modified by using a magnetically operated switch 190 (see FIG. 22) in lieu of the water operated switch 122 shown in FIGS. 13 and 15. Such a switch 190 is held in the "off" position by a small removable magnet 192 and. When the magnet is removed from the exterior of the device, switch 190 will close and activate the circuit the same as in the water actuated circuit shown in FIG. 15. FIG. 22 schematically shows such a switch 190 and magnet 192 which can be substituted for switch 122 at location Y in FIG. 15. The circuit, when turned "on", operates in the same way as does the circuit FIG. 15.

This modified flashing device can only be turned "on" by the removal of an exterior magnet 192 and turned "off" by placing the magnet on the device. The magnet 192 activates an internal magnetic switch 190. This arrangement permits the housing (case) to be totally sealed, as has been described, which means the device may be submerged to great depths because the case can withstand higher pressures, because there is no opening where the switch is located, to be separately sealed. Also, by simply numbering the magnets and placing the removed magnets on an accountability board, when removed from the indicator device, one would know that the person (diver) is submerged and is accounted for.

INFRARED INVISIBLE LIGHT FLASHING INDICATOR

Yet another modification to the Flashing Indicator emissions involves substituting (invisible to the human eye) infrared near infrared L.E.D.'s. These infrared L.E.D.'s permit easy tracking and identification of personnel when viewed through a night vision or similar infrared sensitive detector. The infrared L.E.D.'s exhibit better penetration of fog and smoke than do visible light when viewed through an appropriate infrared detector. A typical application for the infrared L.E.D.'s would be easy identification of members of a police SWAT team or individuals that must be readily identifiable by personnel having an infrared detector but must remain invisible to those who do not have the detectors.

By use of a coded flashing circuit, the light emissions, whether visible or invisible to the naked eye, can be used to identify the wearer. Such coded infrared L.E.D. emissions and detectors are well-known and are used extensively in electronic equipment controllers, i.e., the controllers for TV's, VCR's and audio record players. The coded signals could be used to identify leaders such as a Fire chief, or an assistant chief or a fireman or whatever designations are desired.

The hours of use of the embodiments of FIGS. 1 and 13 is 50 hours, the view of angle of the multiplied light source is 360°, the distance can approach or exceed one mile, the luminescence is 10 candles. The visible light emitting L.E.D.'s used in this invention are a development of Hewlett Packard are identified as Super Bright.

The alternative attachment device 116, shown mounted on the flasher device 114 as shown in FIGS. 13 and 14, includes an adjustable clamp 118 and a loop 120. The loop is made from a tough polycarbonate plastic and has a flat portion 130 that underlies the base of the hollow body 52' adjacent its open end and is rigidly fastened to the base wall 53' as by plastic bonding and/or screws 132. Such screws do not penetrate the base wall of hollow body 52' so as not to destroy the integrity of the water proof nature of the device 114. Loop 120 can be snapped onto a hook of a diver's harness or a parachute harness or harnesses of firemen or Haz Mat personnel or the like. The adjustable clamp 118 can be releasably fitted on the hose of an air or oxygen tank of personnel such as divers, firemen, police, emergency Haz Mat personnel and the like.

FURTHER ALTERNATE EMBODIMENTS

Figure 16:
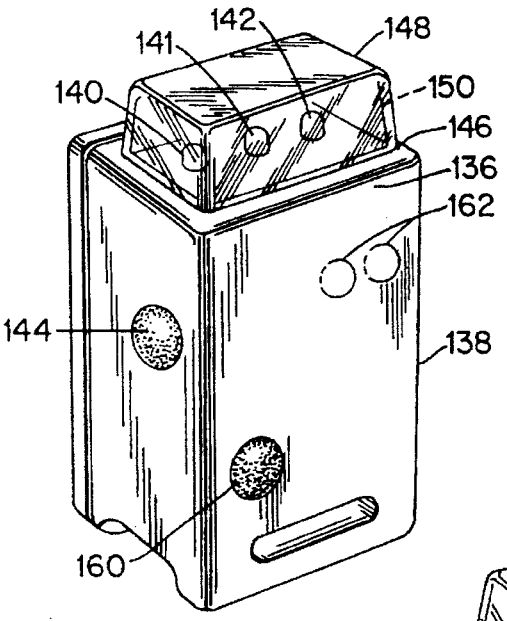
FIG. 16 is a perspective view of a further embodiment of a personal alert safety system device into which a flashing light indicator, in accord with my present invention, has been incorporated.
Figure 18:
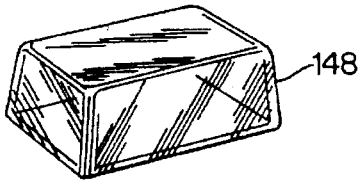
FIG. 18 is a perspective view of the polycarbonate lens overcap used in the embodiments shown in FIGS. 16 and 17.
Figure 19:
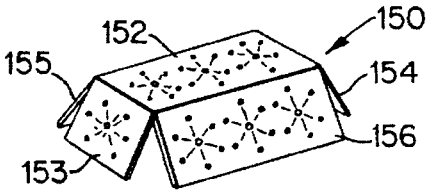
FIG. 19 is a semi-schematic and diagramatic perspective view of a cut and shaped microprism lens sheet of vinyl, bent on bend lines to provide an inner laminate for the overcaps shown in FIG. 18, and schematically illustrating how each of the L.E.D. light sources will appear on the microprism lens sheet surrounded by the six satellite emissions of light.

Known safety system devices such as the PASS device which is the subject of my U.S. Pat. No. 5,317,305 dated May 31, 1994, can be modified to include the visible light or invisible light flashing indicators with light emission multiplication combinations as found in the devices 50 and 114, hereinbefore described, as seen in FIGS. 16, 18 and 19. To this end the subject matter and description of the invention disclosed and described in U.S. Pat. No. 5,317,305 is incorporated herein by reference thereto.

A PASS alarm unit, as described in U.S. Pat. No. 5,317,305, is shown in FIG. 16, modified to include visual light multiplication L.E.D.'S. Such a PASS device can provide a loud audible signal if the wearer becomes immobilized or motionless for a predetermined time period, e.g., for a 25 second time period. The alarm can be heard for a distance of one half mile or more. The same alarm can be manually activated as a call for help. If desired, an alarm system can be incorporated to include a circuit (as described) to respond to excessive temperature and will provide a different sound than the sound for lack of motion or call for help.

Other features can be incorporated in the alarm unit for safety, e.g., means to deactivate an alarm and means to avoid accidental activation.

The PASS unit 136 clearly illustrated in FIGS. 16, is enclosed in a small size, multiple part waterproof case 138 made from high impact polycarbonate plastic, the dimensions of which are approximately 2" wide×3¼" high×1½" deep. With battery, it weights about six ounces. Case 138 encloses a battery, the electronic circuitry, the detectors and sound. transducer, which are assembled into the case from the rear side. The case is sealed in a watertight manner.

Unit 136 can be modified by adding the printed circuitry of the embodiment shown in FIGS. 1–4 to the top of case 136 and the circuit can include the three L.E.D.'s used in the Device 50 of FIG. 1, see L.E.D.'s 140, 141, 142 in FIG. 16. As in U.S. Pat. No. 5,317,305, the system can be activated by pressing the side buttons (switches) on the case. One of the manual side buttons 144 is shown in FIG. 16. Both buttons must be pressed to activate and/or deactivate the system. The circuit for the PASS system is seen in FIG. 22 of my 305 patent.

Placed over the L.E.D.'s 140, 141 and 142 on the top wall. 146 of the case 138 is a transparent, polycarbonate overcap 148 which is rigidly secured and sealed, as by plastic bonding, to the top wall 146. Overcap 148 is shaped as a truncated, four sided pyramid and provides protection for a lens sheet 150 of an array of microprisms which, as seen in FIG. 19, is cut and folded on bend lines to a shape with a flat top section 162, two end sections 153, 154 and two side sections 155, 156. The folded sheet 150 has the microprisms on the outer surfaces of the sections and will have a shape which fits into the lens overcap 145. Each of the sections 152–156 is a light emission multiplier, as explained supra in reference to FIGS. 8–11, so the light multiplication of the three diodes 140, 141 and 142 will occur through the different sections 152–156 as schematically depicted in FIG. 19, to have multiplied light emissions through the top, both side sections and both end sections in multi-directions.

The sheet material from which the array of micro-prisms is constructed may be colored as previously described for sheet 30 (FIGS. 10 and 11) or the sheet may be made from clear transparent vinyl plastic and the overcap can be made from an appropriately colored plastic to provide a light emission with a color that penetrates the surrounding media, be it smoke, dust., darkness, or murky water. While the number of diodes is shown in FIG. 16 as three, the number is not critical but can be a single diode or any number within reason for the size of the unit. Also any electrical engineer, who is skilled in circuitry as shown in FIGS. 12 and 15 and in the U.S. Pat. No. 5,317,305, will know how to modify the circuit to include a different number of diodes than the three diodes which are shown.

Although not shown, the lens overcap of FIG. 16 can made with a curved dome configuration or with an elongate curved contour similar to that shown in FIGS. 1 and 13. It is also contemplated that the thin vinyl sheet of the array of microprisms can be formed as a curved dome or contoured insert to fit any desired shape of the protective overcap.

In FIG. 16, the button 160 is present in the PASS device, as described in U.S. Pat. No. 5,317,305, to operate a switch in the circuit to activate an emergency call signal. It is not per sea part of the present invention. Also shown in phantom lines in FIG. 16 are two plastic lenses 162 which cover two alternately flashing diodes as described in my aforementioned U.S. Patent. If desired, the plastic lenses 162 of the prior known PASS device can be replaced by a lens array of microprisms and a protective overcap to provide alternately flashing diodes with light multiplication in accord with this invention. Obviously, if desired, the alternately flashing diodes could be located on top of the case 138 under the disclosed overcap 148 and light multiplication lens array of microprisms within the overcap.

Figure 17:
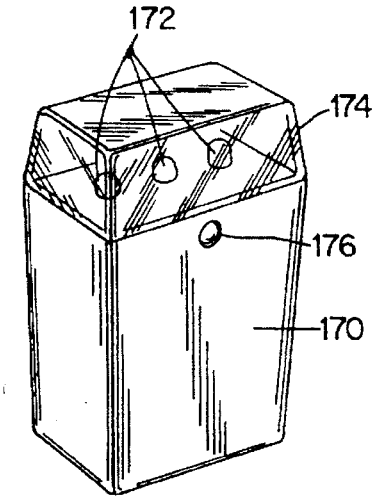
FIG. 17 is a perspective view of another alternative embodiment light emitting indicator device, for use in underwater and hazardous explosive situations, shaped differently from the devices shown in FIGS. 1 and 13.

Possible modified embodiments are numerous, and one of those is shown in FIG. 17 which illustrates a further small light multiplication flashing unit 170 with a molded. polycarbonate case that can carry two small AAA batteries, a printed circuit board and L.E.D.'s 172 inserted from the top end and covered by a polycarbonate lens overcap 174 with an inserted folded sheet of an array of microprisms similar to that described for FIG. 16. The overcap is waterproof and sealed in place on top of the unit 170 with waterproof plastic bonding so the entire unit is in a waterproof container. Component 176 can be a manually operated button for activating a microswitch in circuitry like that of FIG. 12 or alternatively an aperture permitting access for moisture (water) to activate a water switch as shown in the circuitry of FIG. 15.

Figure 20:
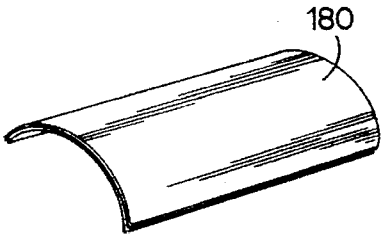
FIG. 20 is a perspective view of an alternative microprism array for use in the device shown in FIGS. 1–5 laminated from several foils of plastic sheet forms.
Figure 21:
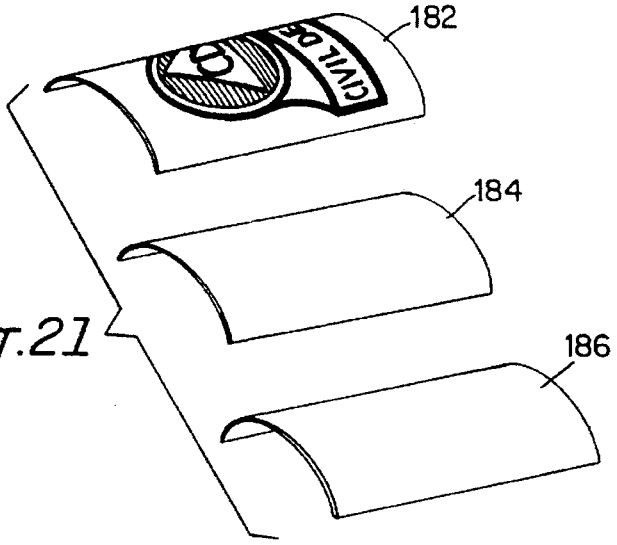
FIG. 21 is an exploded view showing the individual laminates of the array in FIG. 20 and illustrating how the, outer laminate can provide a surface for identifying indicia for personnel.

The light emission multiplication lens sheet with the array of microprisms can be a single film or foil of vinyl or suitable plastic as shown in FIG. 9, 10, 11 and as element 74 in FIG. 5, but a more suitable light multiplication lens is a laminate of several films, a central one having the array of microprisms. Such an example is a curved laminated sheet 180 which can be used in lieu of the curved sheet 74 in FIG. 5. As depicted in FIG. 21 the laminated sheet includes three films, an outer clear polyester film 182 which overlies the microprism side of the intermediate vinyl film 184 which is a lens sheet of an array of microprisms. Outer film 182 or laminate is a protective cover for the minute microprism shapes and can also be used to include a visual indicia such as, an advertising message, a unit logo or personal name etc. which can be seen through the cover of a device as shown in FIG. 1. The third and innermost or bottom film 186 of the laminated sheet is a clear polyester plastic lens sheet which aids in supporting and providing a stable shape to the laminated sheet. Obviously the light emission multiplication sheet material of an array of microprisms, as previously described for various embodiments can be made as a laminated structure in the manner described for the sheet shown in FIGS. 20 and 21.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A personal safety device comprising: L.E.D. means for providing light, a power source for providing electrical power and coupled with the L.E.D. means, switch means for connecting the power source with the L.E.D. means; a case enclosing the L.E.D. means and power source, the case including a plastic overcap overlying the L.E.D. means; and a plastic sheet having a transparent microprism array and positioned between said overcap and the L.E.D. means with the microprism array facing the overcap, wherein the microprism array provides multiplication of light emitted by the L.E.D. means by displaying at the overcap a plurality of spaced concentrations of the light emitted by the L.E.D. means.

2. A device as defined in claim 1, wherein said L.E.D. means emits visible light and includes at least one super bright L.E.D..

3. A device as defined in claim 2, wherein said L.E.D. means includes at least three said super bright L.E.D.'s.

4. A device as defined in claim 1, wherein said overcap is colored with a color that emits a penetrating visible light when the L.E.D. means emit visible light.

5. A device as defined in claim 1, wherein said microprism array is made from vinyl which is colored in a color selected from the group consisting of white, yellow, orange, red, blue, green and fluorescent colors so light emitted by the L.E.D. means and passing through the microprism array will be of a color that is visible through the surrounding atmosphere.

6. A device as defined in claim 1, wherein said plastic sheet means is an assembly of a plurality of at least three sheets including a base polyester film, a microprism array made from vinyl and overlying the base polyester film, and a protective cover sheet made from clear polyester plastic and overlying the microprism array.

7. A device as defined in claim 6, wherein the protective cover sheet includes distinctive indicia.

8. A device as defined in claim 1, wherein the overcap is made from a polycarbonate plastic.

9. A device as defined in claim 1, wherein said case includes wall portions and said switch means is mounted within said case adjacent one of said wall portions and a sealed elastic push button means is located in said one wall portion enabling activation of said switch means from an exterior part of said device.

10. A device as defined in claim 1, wherein said case is a waterproof case and includes end wall portions, and said switch means is mounted in one of said end wall portions and is a moisture activated switch including two electrically conductive pins connected to said power source and projecting exteriorly through said one of said end wall portions from interiorly of said case, and seal means around said pins and engaging said one end wall portion for providing a waterproof seal between said pins and said case.

11. A device as defined in claim 1, wherein said case is substantially rectangular with dimensions of approximately 2⅜" long, 1⅝" wide and ⅞" thick; and wherein said case includes two major parts, a lateral hollow chamber with a convex upper wall defining said overcap, said convex upper wall being curved from side to side in the width dimension and said hollow chamber being open at one end of its length; and an end cap which abuts and is sealed by a seal means to said one open end of said hollow chamber; said hollow chamber including an interiorly positioned longitudinal track along each of a pair of opposed side walls, said tracks each having upper edge portions shaped to provide upwardly facing longitudinal interior steps along each side wall and extending the length of said hollow chamber enabling said plastic sheet with the array of microprisms to be placed into said hollow chamber and held by said steps in matching conformity with an interior surface of the curved wall overcap hollow body; said end cap carrying an integral tray shaped to engage with and to slide along said longitudinal tracks into said hollow chamber; fastening means including a first fastening member on the tray and a second, cooperating fastening member carried by the hollow chamber for enabling said tray to be securely releasably fastened to said hollow chamber; said tray providing mounting means for mounting said L.E.D. means and said power source; and sealing means for providing a waterproof seal between the end cap and said hollow chamber and between said second fastening member and said hollow chamber.

12. A device as defined in claim 11, wherein said switch is located on said tray adjacent said end cap and a sealed elastic push button means is located in said end cap for enabling activation of said switch means from outside said device.

13. A device as defined in claim 11, wherein the tray carries a printed circuit board having a control circuit for controlling operation of the L.E.D. means.

14. A personal safety device as defined in claim 1 in combination with a personal alert safety system.

15. The combination defined in claim 14, wherein an auxiliary plastic overcap is mounted on top of the personal alert safety system case and encloses said plastic sheet with the array of microprisms and said overcap and sheet means overlays the L.E.D. means which are mounted on top of the personal alert safety system; said overcap having an upper wall and four side walls, wherein said plastic sheet is shaped to fit inside said overcap and against interior surfaces of said overcap.

16. The combination defined in claim 14, wherein said case includes wall portions and said switch means is mounted within said case adjacent one of said wall portions and a sealed elastic push button means is located in said one wall portion enabling activation of said switch means from an exterior part of said device.

17. The combination defined in claim 14, wherein said case is a waterproof case and includes end wall portions and said switch means is mounted in one of said end wall portions and is a moisture activated switch including two electrically conductive pins connected to said power source and projecting through said one of said end wall portions from interiorly of said case to exteriorly of said case, and seal means around said pins and engaging said one end wall portion for providing a waterproof seal between said pins and said case.

18. The combination defined in claim 13, wherein encapsulation means, including a silicon plastic coating, is provided for completely encapsulating said printed circuit board, said L.E.D. means, said power source, and said switch means to render said components as a waterproofed subcombination within said case.

19. The combination defined in claim 18, wherein said switch means is an "on-off" microswitch with an operator stem located adjacent an inner case side of a manually operable, elastic push button means located in said end cap.

20. A device as defined in claim 1, wherein said L.E.D. means emit light invisible to the human eye.

21. A device as defined in claim 20, wherein said L.E.D. means include at least one super bright L.E.D..

22. A device as defined in claim 21, wherein said L.E.D. means include at least three said super bright L.E.D.'s.

23. A device as defined in claim 20, wherein said L.E.D. means emit infrared light.

24. A device as defined in claim 23, wherein said L.E.D. means include at least one super bright L.E.D..

25. A device as defined in claim 23, wherein said L.E.D. means includes at least three super bright L.E.D.'s.

26. A device as defined in claim 23, including circuit means for enabling said L.E.D. means to emit coded infrared light emissions.

27. A safety device system including at least one safety device as defined in claim 20, and including detector means for detecting emissions of invisible light emitted by the L.E.D. means.

28. A safety device system including at least one safety device as defined in claim 23, and including detector means for detecting emissions of infrared light emitted by the L.E.D. means.

29. A safety device system including at least one safety device as defined in claim 26, and including detector means for detecting coded infrared light emitted by the L.E.D. means, wherein said detector means includes a decoder and an indicator for decoding and indicating a meaning of the coded infrared light emissions from the at least one safety device.

30. A safety device system as defined in claim 29, including a plurality of said at least one safety device, wherein each of said plurality of safety devices emits a different and distinctive coded infrared light emission.

31. A device as defined in claim 1, wherein said case is a waterproof case and includes end wall portions and wherein said switch means is mounted inside of said case adjacent one of said end wall portions and is a normally closed, magnetically actuated on-off switch, and a magnet structurally separate and removable from said case is located exteriorly of said case adjacent the magnetically actuated on-off switch and magnetically maintains the switch in an opened condition, so long as the magnet is not removed from the case.

32. A safety device system including at least one safety device as defined in claim 31, wherein a magnet on said at least one safety device has unique identifying indicia thereon.

33. A safety device system as defined in claim 32, including a plurality of said at least one safety device, wherein each of said safety devices includes a separable, switch-operating magnet and each said magnet has different identifying indicia thereon.

34. A safety device system as defined in claim 33, further including an accountability board including holding means for holding and visually displaying the magnets when the magnets are removed from a safety device, to account for particular personnel wearing an activated safety device.

35. A device as defined in claim 1, wherein said case includes a hollow chamber with a convex upper wall defining said overcap, said convex upper wall being curved from side to side in the width dimension and said hollow chamber being open at one end of its length, and an end cap which abuts and is sealed by a seal means to said one open end of said hollow chamber, said hollow chamber including an interiorly positioned longitudinal track along each of a pair of opposed side walls, said tracks each having upper edge portions shaped to provide upwardly facing longitudinal interior steps along each side wall and extending the length of said hollow chamber for receiving and retaining said plastic sheet with the array of microprisms against an interior surface of the curved wall overcap hollow body, said end cap carrying a tray shaped to engage with and to slide along said longitudinal tracks into said hollow chamber; and fastening means including a first fastening member on the tray and a second, cooperating fastening member carried by the case for enabling said tray to be securely releasably fastened to said case, said tray including mounting means for mounting said L.E.D. means and said power source.

36. A device as defined in claim 1, wherein the plastic sheet includes a first, smooth surface facing the L.E.D. means, and a second surface on which the microprism array is carried and which faces the overcap, wherein the microprism array includes a plurality of individual microprisms disposed in side-by-side relationship on the second surface of the plastic sheet.

37. A device as claimed in claim 36, wherein the microprism array extends over substantially the entire second surface of the plastic sheet.

38. A device as claimed in claim 37, wherein the individual microprisms are in contacting, side-by-side relationship.

39. A device as claimed in claim 1, wherein the microprism array is defined by a plurality of three-sided, pyramidal microprisms.

40. A device as claimed in claim 1, wherein the plastic sheet is spaced from the L.E.D. means a distance of from about 1 mm. to about 7 mm.

41. A device as claimed in claim 1, wherein the spaced concentrations of light include a central concentration of light opposite from the L.E.D. means and a plurality of secondary concentrations of light spaced from and surrounding the central concentration of light.

42. A device as claimed in claim 41, wherein the secondary concentrations of light are symmetrically positioned around the central concentration of light.

* * * * *